United States Patent [19]

Oginz

[11] Patent Number: 4,713,920

[45] Date of Patent: Dec. 22, 1987

[54] MODULAR TONGUE AND GROOVE REMOVABLE PANEL PARTITION SYSTEM

[76] Inventor: Stanley Oginz, Pink Dogwood Farm, Hadensville, Va. 23067

[21] Appl. No.: 877,235

[22] Filed: Jun. 23, 1986

[51] Int. Cl.[4] ..... E04B 2/74

[52] U.S. Cl. ..... 52/582; 52/127.7; 52/241

[58] Field of Search ..... 52/127.1, 127.7, 127.8, 52/126.3, 593, 586, 582, 127.11, 241, 238; 292/183, 189, 63, 67

[56] References Cited

U.S. PATENT DOCUMENTS 3,236,014 2/1966 Edgar ..... 52/593
3,278,954 12/1973 Meserole ..... 52/586
3,355,848 12/1967 Ulery ..... 52/238.1
3,699,734 10/1972 Craig ..... 52/586
3,995,402 12/1976 Parenteau ..... 52/586

*Primary Examiner*—John E. Murtagh
*Attorney, Agent, or Firm*—Lee C. Robinson, Jr.

[57] ABSTRACT

A partition system with modular panel units having a retractable tongue mounted in one end and a groove, which cooperates with the tongue of an adjoining panel, mounted in the opposite end. An individual panel unit is released from interlocking relationship with adjoining units by retraction of the tongue so as to enable the unit to be removed without having to disassemble adjacent portions of the partition. Removed panel units can easily be replaced with functional alternatives such as hinged doorways or windows.

5 Claims, 6 Drawing Figures

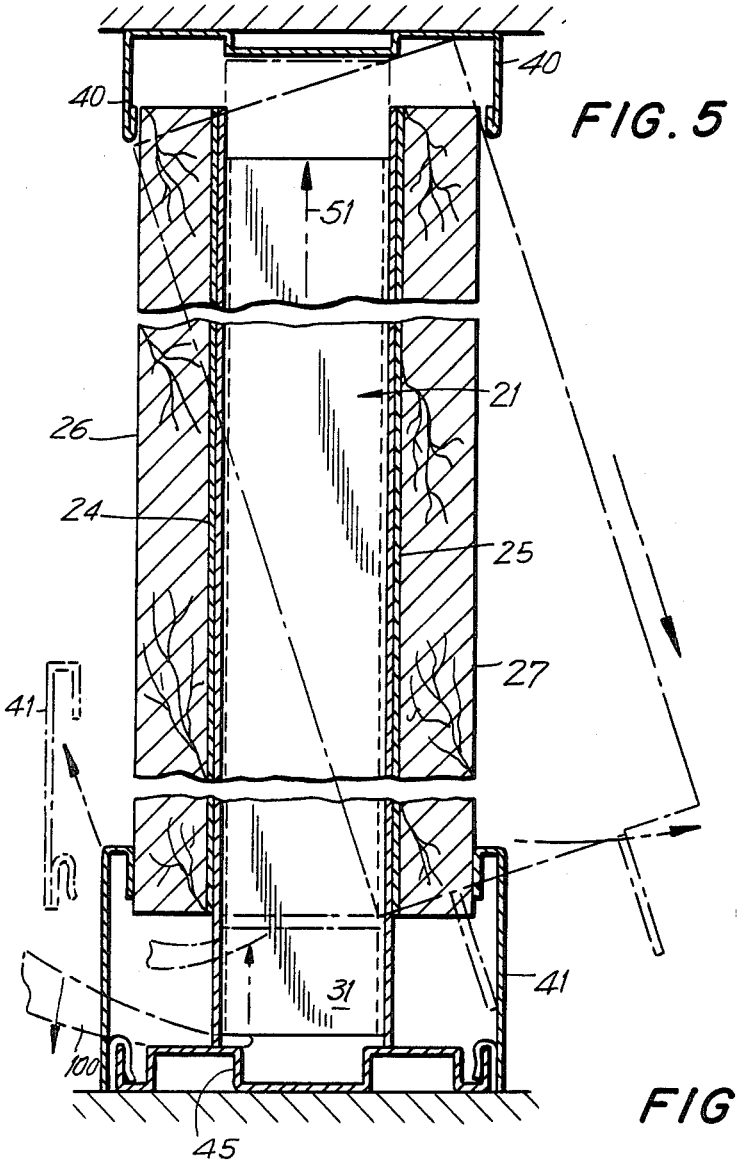
FIG. 5
FIG. 6
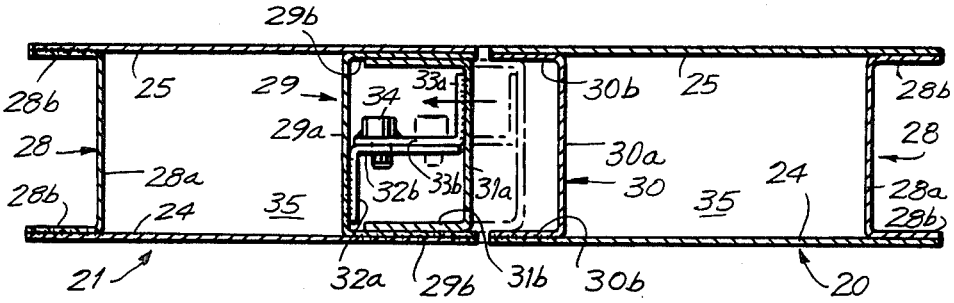

MODULAR TONGUE AND GROOVE REMOVABLE PANEL PARTITION SYSTEM

FIELD OF THE INVENTION

This invention relates to partition systems and more particularly to modular, easily assemblable partition structures, assembled from a plurality of interlocking panels, wherein an individual panel may be removed without the need for disassembling adjoining panels.

BACKGROUND OF THE INVENTION

Partition structures made up of an assembly of panels and the like are widely used to divide the interior areas of buildings, such as offices and classrooms. Such structures are often referred to in the trade as "movable" walls or partitions. Modern partition systems are generally classified according to two types: namely those comprising panel members and posts, located at intervals along the wall, to which the panel members are affixed by a variety of hooks, clamps, and other interlocking means; and those which dispense with the need for posts by having the panels themselves directly interlockable with one another.

Systems utilizing the panel and post type construction are generally further characterized depending upon whether the posts are visible from the exterior surface of the wall, or are concealed in the interior of double-wall type construction. For aesthetic reasons the concealed post type construction is usually preferred because the continuity of the wall surface is maintained. Structures in which the panel members are connected to the posts so as to leave the posts visible from the exterior of the wall are however generally considered somewhat more practical from a functional point of view, in that bracket means for mounting shelves, cabinets and the like to the wall may be more readily installed, and because utilities such as electrical wiring, which are often carried through the posts, are more readily accessible.

The second major type of partition dispenses with the need for using separate posts by incorporating the means for interlocking adjoining panels into the ends of the panels themselves so that abutting panels form a single-line joint. This type of construction is generally considered to be most desirable in that it achieves the better aesthetic appearance of the concealed post and panel type construction, having smoother lines and a greater appearance of wall surface continuity than the visible-post type construction, while dispensing with the need for separate post elements.

Partition systems of any of the foregoing types of construction may generally extend either from the floor to the full height of the ceiling thereby creating a true wall, or they may be erected to a lesser height so as to function as a separator, dividing a large area into a number of separate smaller areas while leaving a common air space extending between the tops of the partitions and the ceiling overhead.

Wall panel members should be rigid, yet lightweight. Where postless type construction is used, it is particularly important that the wall panel members be capable of supporting their own weight without bowing or warping, as well as being capable of sustaining any active loads, such as cabinets or shelves, suspended from them. It is often important that the panel members have good thermal and acoustical insulating properties. Panel members are generally fabricated from sheet metal. Where double-panel construction is utilized, the interior space between the two panels is often filled with materials such as rock-wool or fiberglass insulation. It is also desirable that individual wall panel members be capable of being substituted with functional alternatives, such as doorways, glass panels, or windows.

Although numerous designs for partition systems have been proposed, none has been of a truly modular design. When reconfiguring a work space, it may often be advantageous to incorporate existing parts of a previously constructed partition, making only slight changes in layout. In such cases it it desirable to be able to merely rearrange or remove one or more individual panels, or replace them with functional alternatives such as doorways, rather than disassemble an entire wall section.

Unfortunately, many of the systems previously developed, although supposedly capable of easy assembly and disassembly, are not readily adaptable to situations requiring the removal or replacement of only single panel members. Because of the peculiarities of the methods of interlocking the individual panel and/or panel and post elements of previous systems, difficulties have been encountered in removing an individual panel member without disrupting an entire wall section and requiring the removal of at least the immediately adjacent panel member to either side of the panel which is to be removed, thus creating a sort of chain reaction effect. Moreover, some systems which nominally appear to allow the removal of an individual panel member without disrupting an entire wall section are not, in practice, really quite as flexible, particularly in the case of full floor-to-ceiling height units. Because of the nature of their construction, the panel interlock mechanism of some systems requires the removal of elements perpendicular to the surface of the partition or, in some cases, causes the projection of interlock members above the nominal height of the panel member itself, in order to release an individual panel from its interlocking relationship with adjoining panels.

Panel members, even those for use in full floor-to-ceiling height applications, are generally of lower height than the full floor-to-ceiling distance to allow for variation in the room height along the length of the wall. At the base, the panels may either rest on the floor or on a supporting structure some distance off the floor. A clearance between the wall panel and the ceiling is generally left at the top. Baseboard and ceiling moldings are used to cover the lower and upper clearances, respectively, thereby creating a more aesthetic appearance. These moldings, however, generally extend for lengths greater than the widths of several individual panel members. Because of this, it is not possible to remove individual panel members, particularly where projections either perpendicular to the surface of the member or above and below the member within its plane exist when the panel member is released from its interlocking assembly with adjacent members, without first having to remove a section of baseboard and/or ceiling molding to provide the requisite clearance for extricating the panel member.

A definite need exists, therefore, in the art of partition systems for a structure that is capable not only of being easily assembled with a plurality of like or similar members into a wall of desired length, or of being disassembled when the wall is no longer desired, but also is able to be detached as a single unit from an existing wall when it is desired to either remove such unit or replace it with a similar unit of different functional utility, such as a doorway, without the need to remove adjacent panel members.

BRIEF SUMMARY OF THE INVENTION

One general object of this invention, therefore, is to provide a new and improved partition system.

More specifically, it is an object of the invention to provide such a partition system in which individual panel units of the system are removable without having to dismantle adjoining units.

An additional object of the invention is to provide a partition system in which functional alternatives to individual panel units, such as doorways, can readily be substituted for panel units.

A still further object of the invention is to provide a partition system utilizing comparatively simple mechanical components which are economical to manufacture and which may be quickly and easily installed in an interior building space.

In a preferred embodiment, individual panel units each have a retractable tongue at one vertical edge and a groove in the opposite vertical edge, such that the extended tongue of one panel unit is capable of cooperating in interlocking relationship with the groove in another panel unit. When a series of such panel units are positioned in adjoining relationship, the tongue-end of one panel unit abuts the groove-end of the adjacent panel unit to form a single-line joint therebetween.

Each of the individual panel units is made from a pair of spaced plates connected at their opposite ends by vertical channel brackets, thus forming a double-wall type construction having an empty space between the plates. The retractable tongue at one end of each panel unit is movably affixed to the channel bracket by at least one pair of tongue retraction brackets.

A panel unit is released from its interlocking relationship with adjoining units by the application of a lifting force to the bottom of the tongue thereby causing it to retract into the channel bracket of the unit to which it is movably attached.

In accordance with some embodiments of the present invention, panel facings may be attached to the plates of a panel unit to give a panel unit additional strength and rigidity, to provide better thermal and/or acoustical insulating properties to the panel units, and/or to provide a more aesthetic appearance. Particular facing materials include sheet rock and vinyl.

In accordance with a feature of some embodiments of the present invention, the empty space formed by the first and second plates and first and second channel brackets of a panel unit is filled with a fiber insulating material such as rock-wool, or fiberglass.

The present invention, as well as further objects and features thereof, will be more fully understood from the following description of certain preferred embodiments, when read with reference to the accompanying drawings.

BRIEF DESCRIPTION OF THE DRAWINGS

FIG. 5 is an enlarged fragmentary vertical sectional view taken along the line 5—5 in FIG. 2 showing the method of removal of a panel member.

FIG. 6 is a horizontal sectional view of a wall panel member identical to that shown in FIG. 2 except showing the tongue in the retracted position.

DETAILED DESCRIPTION OF CERTAIN PREFERRED EMBODIMENTS

Figure 1:
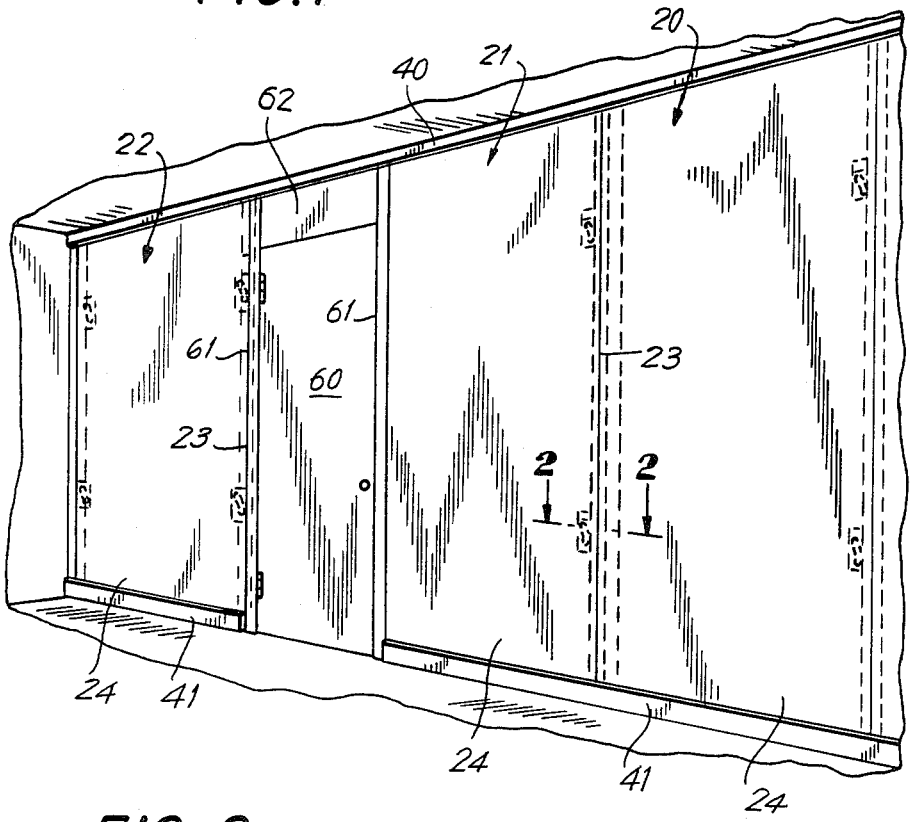
FIG. 1 is a fragmentary perspective view of a partition system constructed in accordance with one illustrative embodiment of the invention.
Figure 2:
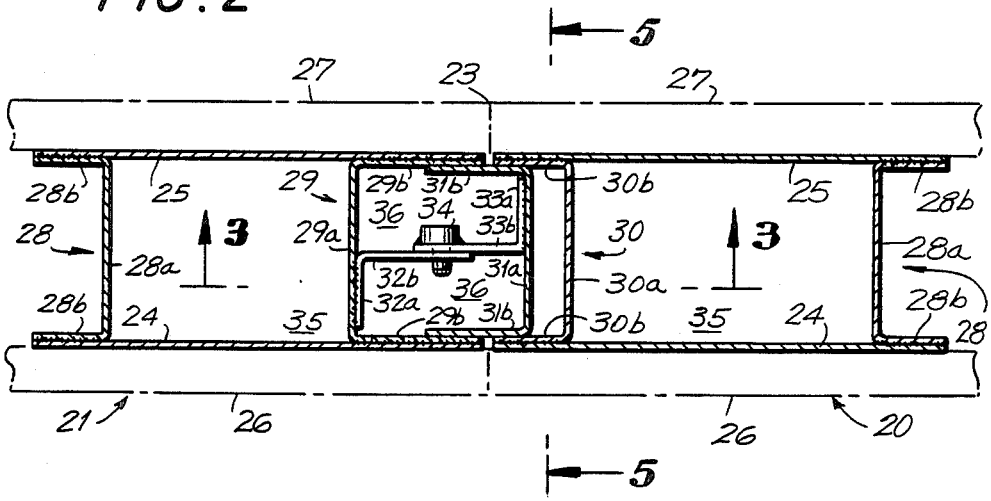
FIG. 2 is a horizontal section view taken along the line 2—2 in FIG. 1.

Referring to FIGS. 1 and 2 of the drawings, the partition system comprises a wall constructed from a series of upright panel units 20, 21, and 22 arranged between the floor and ceiling of an interior building space. In the illustrated embodiment, the panel units 20 and 21 are arrayed in a vertical plane and abut one another to provide a single line joint 23 therebetween. Panel unit 22 is shown adjacent to a hinged doorway unit 60 which has been substituted for a removed panel unit. The construction of such a doorway unit is more fully described below. Panel unit 22 likewise forms a single-line joint 23 with doorway unit 60.

Each panel unit is formed from a pair of spaced-apart plates 24 and 25 which illustratively are fabricated from steel, but can be fabricated from any rigid, self-supporting material. Where it is desired that the wall panel units have greater thermal and acoustical insulating properties than can be achieved solely with the material of the plates, or where it is desired to give more of an appearance of finished walls, panel facings such as of sheet rock or vinyl can be optionally affixed to the exterior of one or both of the surface members. FIG. 2 shows in dashed outline such panel facings 26, 27 attached to first and second plates 24, 25 respectively.

The first and second plates of a panel unit are connected by means of U-shaped channel brackets 28, 29, 30. FIG. 2 shows a first panel unit having a channel bracket 28 at one vertical edge and a channel bracket 30, adapted for use as a groove, at an opposite vertical edge. Adjoining panel unit 21 has U-shaped channel bracket 28 at one edge and U-shaped channel bracket 29, forming a tongue mounting bracket, at an opposite edge and adjoining the edge of panel unit 20 having U-shaped channel bracket 30 forming a groove.

Each U-shaped channel bracket 28 which functions simply as a joining element for the two plates has a main front portion **28*a*, which is perpendicular to the first and second plates and whose length determines the thickness of the wall; and first and second side portions 28*b*, extending perpendicular to the front portion of the bracket and parallel to the first and second plates, respectively. Similarly, the channel bracket 29 adapted for use as a tongue mounting bracket and the channel bracket 30 used as a groove each have main front portions 29*a*, 30*a*, which are perpendicular to the first and second plates, and first and second side portions 29*b*, 30*b*** extending perpendicular to the front portion of the brac-ket and parallel to the first and second plates, respectively. The channel brackets are permanently affixed at their side portions to the first and second plates, such as by welding. The channel brackets extend for the full height of the panel unit, thereby giving the panel unit strength and rigidity and preventing the first and second plates from bowing or moving in a sliding direction with respect to one another in the planes of their surfaces.

The first and second plates 24, 25 together with the first and second channel brackets 28 of a panel unit create a space 35 in each panel unit open at the top and bottom of the unit. These spaces may remain empty, or where it is desired to improve the thermal and acoustical insulating properties of the panel unit, they may be filled with an insulating material such as fiberglass or rock-wool. The spaces may be filled with such material either in place of using first and/or second outer panel facings, or in addition to the use of such outer panel facings to further increase the insulating properties of the panel unit. Because the filling materials are generally low-density, and because forces of compression and adhesion attract the filling materials to the inner surfaces of the plates, the spaces may be left open at the bottom with little likelihood of the filling material settling or falling through, however, optional bottom and/or top sealing panels (not shown) may be used to fully enclose the spaces.

The channel bracket 29 adapted for use as a tongue mounting bracket 29 (FIGS. 2 and 3) has a slotted tongue retraction bracket 32 affixed thereto. The shape of the retraction bracket 32 is not critical as long as it provides both a portion capable of being fastened to the channel bracket 29 and a portion perpendicular to the channel bracket and parallel to the planes of the plates capable of bearing a slotted zone. The retraction bracket 32 is most preferably L-shaped, as is shown in FIG. 2, having a base **32*a* and a side 32*b*. The base 32*a* of the retraction bracket 32 is affixed to the front portion of the channel bracket 29*a*, such as by welding. The side 32*b* of the retraction bracket 32 is oriented in a direction parallel to the wall and has a slotted opening in its surface. The slotted opening in the side 32*b* of the retraction bracket 32 has a first portion disposed in a vertical direction and a second portion which communicates with the first portion and is disposed above the first portion at an oblique angle thereto, so that the first and second portions of the slotted opening together are capable of guiding a connecting means 34 on tongue retraction bracket 33 along a path to produce cam-like motion of a tongue 31**, as will be described.

Each panel unit has two retraction brackets 32 affixed to the channel bracket 29 at points along the height of the channel bracket. In other embodiments, the panels have from one to four retraction brackets 32. Where a single retraction bracket 32 is used, it should extend over substantially the entire height of the channel bracket 29 and should have a plurality of the aforesaid slotted openings in its side portion. It is, however, preferable to utilize a plurality of retraction brackets 32 each individually having a smaller base and side height than a single, full height retraction bracket, with each having a slotted opening in its side portion as described above. The use of a plurality, most preferably two such brackets, each having a height of from four to six inches, provides for a uniform retraction of the tongue 31 into the channel bracket 29, as is more fully described below, and further reduces the amount of material and hence the cost of the retraction brackets 32. For example, good operation of the tongue retraction mechanism is achieved with the use of two L-shaped retraction brackets 32, with one located at a distance up from the bottom of the panel unit approximately one-third of its height and a second one located at a distance down from the top of the panel unit approximately one-third of its height.

Each retraction bracket 32 affixed to the channel bracket 29 has another tongue retraction bracket 33 associated with it. The tongue retraction bracket 33 has a base **33*a* and a side 33*b*. Connecting means 34 is attached to the side 33*b*. The base 33*a* of each retraction bracket 33 is affixed to the tongue 31. The tongue retraction brackets 33 are most preferably L-shaped, as is shown in FIG. 2**.

The base **33*b* of each tongue retraction bracket 33 is affixed, such as by welding, to the inside of the front portion 31*a* of the tongue at a location vertically along the tongue 31 corresponding to that of a tongue retraction bracket 32. A single tongue retraction bracket 33** may alternatively be utilized.

Connecting means 34 movably joins tongue retraction bracket 33 with tongue retraction bracket 32 by cooperating with the slotted opening in tongue retraction bracket 32. The connecting means 34 can be a pin having a square or preferably a circular cross section of slightly smaller-diameter than the slotted openings in the side of tongue retraction bracket 32 so as to be capable of freely sliding along the slotted opening. The connecting means 34 is fixedly attached to the side **33*b* of tongue retraction bracket 33, as by welding, and is oriented so as to line up with and slidably cooperate with the slotted opening in the side 32*b* of tongue retraction bracket 32. Connecting means 34 preferably has one end opposite to another end attached to retraction bracket 33 flared after insertion through the slotted opening in tongue retraction bracket 32 so as to prevent retraction brackets 32 and 33** from inadvertently disengaging.

The tongue 31 is a U-shaped bracket having a main front portion **31*a* perpendicular to the first and second plates 24, 25 and first and second side portions 31*b* perpendicular to the front portion and parallel to the first and second plates. The overall width of the tongue is somewhat narrower than that of a channel bracket so as to be able to fit inside channel bracket 30 used as a groove when extended and upon retraction to fit inside channel bracket 29** to which it is movably attached.

The tongue 31 is positioned such that its side portions **31*b* face inwardly toward the center of the panel unit. The channel bracket 29 to which the tongue is mounted and the tongue 31** form a conduit which is capable of carrying electrical wiring.

The tongue 31 is movable from a first position to a second position. In the first position the tongue 31 is in interlocking relationship with the channel bracket 30 used as a groove, in the abutting end of an adjoining panel unit, while in the second position the tongue is retracted into channel bracket 29 of the panel unit to which it is attached via the tongue retraction brackets 32 and 33. To retract the tongue 31, a lifting force is applied from beneath the tongue utilizing a suitable tool such as a crowbar. The lifting force causes the tongue to move from its first position in interlocking relationship with the groove in the adjoining panel unit along a vertical path, and then along an oblique path to the retracted, second position inside the channel of the panel unit to which the tongue is attached. The path of motion of the tongue 31 is determined by movement of the pin 34 attached to retraction bracket 33 relative to the slotted opening in the side **32*b* of retraction bracket 32 with which the pin 34** cooperates.

Figure 3:
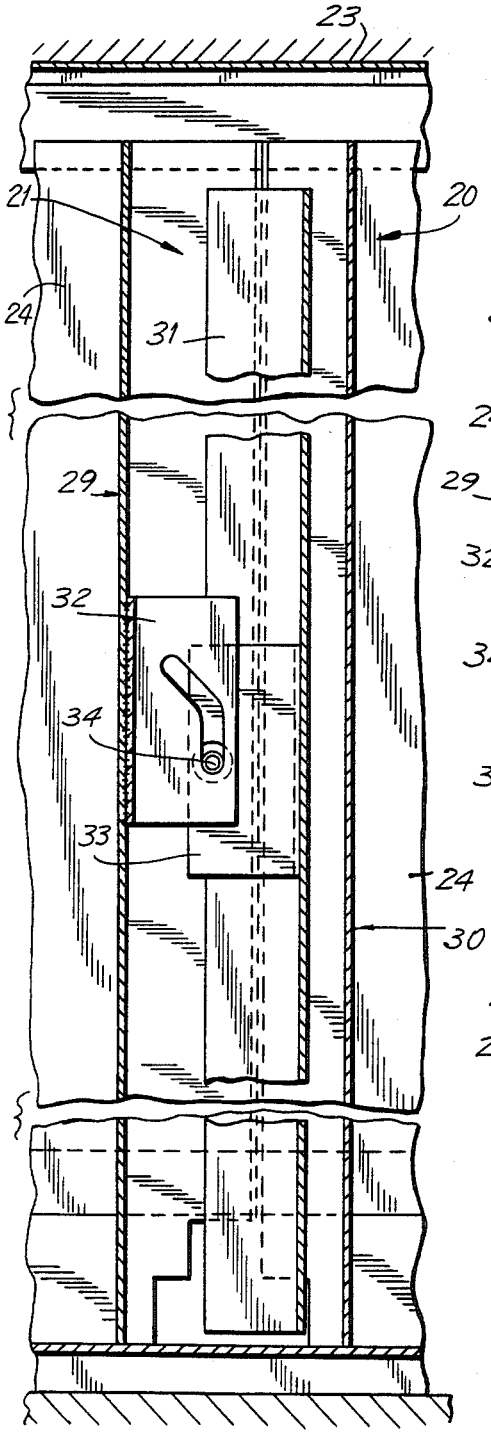
FIG. 3 is a vertical section view taken along the line 3—3 in FIG. 2 showing the tongue end of one panel member with the tongue deployed in interlocking relationship with the groove end of another panel member.
Figure 4:
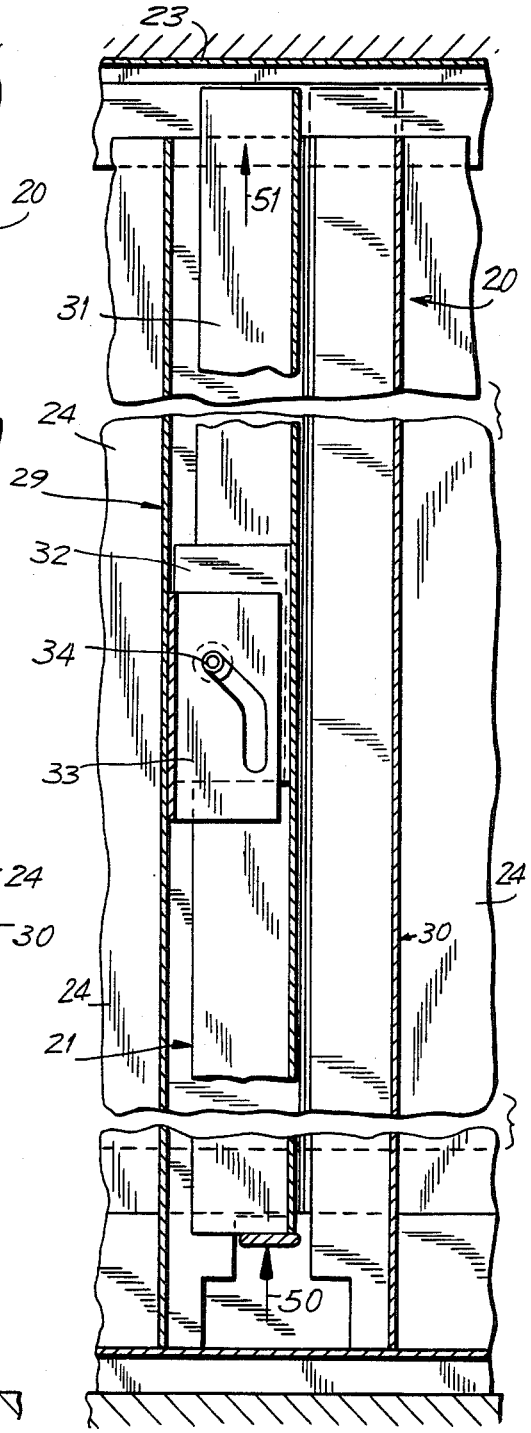
FIG. 4 is a vertical sectional view identical to that in FIG. 3 except that the tongue member is shown in the retracted position.

The first and second positions of the tongue are more clearly illustrated in FIGS. 3 and 4, respectively. FIG. 3 shows the tongue 31 at the tongue mounting edge of a first panel unit 21 in interlocking relationship with the groove formed by channel bracket 30 in an abutting end of an adjoining panel unit 20. The two panel units 20 and 21 form a single-line joint 23. The pin 34 is in position at the bottom of the vertical portion of the slotted opening in the tongue retraction bracket 32.

FIG. 4 shows the tongue 31 released from interlocking relationship with the groove formed by the channel bracket 30. The tongue 31 is retracted into the channel bracket 29 in the abutting edge of the adjoining panel unit 21.

The application of the force needed to move the tongue 31 into the retracted position is shown by an arrow 50, applied at the base of the tongue. An arrow 51 illustrates the direction of motion of the tongue. When the tongue is in its retracted position, the pin 34 is in its raised position at the upper end of the obliquely slotted portion of the slotted opening in the tongue retraction bracket 32. After the tongue has been retracted, the panel unit to which it is attached, in this case panel 21, can easily be removed from its position in the wall with respect to the adjoining units.

Absent the application of a raising force, the tongue 31 is in the first position in interlocking relationship with the groove in an adjoining panel unit. This prevents the inadvertent disengagement of a panel unit which might otherwise occur if the tongue were permitted to remain in the retracted, second position.

The gap between the bottom of the plates and panel facings and the floor is covered with baseboard molding strips 41. The strips 41 have inverted U-shaped clips along their bottom edges which interlock with a U-shaped groove along the outer edge of each side of the floor support track 45. The upper edges of the clips rest against the outside of the panel facings 26 and 27.

The gap between the top of a panel unit and the ceiling is covered by a ceiling molding strip 40. The strip 40 is attached to the exterior of the wall panel unit at each side near the ceiling line. The ceiling molding strip 40 forms a track which maintains the panel units in vertical alignment. A significant improvement of the partition system of this invention is that, unlike other systems, it is not necessary to also remove the ceiling molding strip 40 in order to disengage and remove an individual panel unit.

The disengagement of the tongue of one panel unit from the groove in an adjoining panel unit is indicated by the transition from the first position shown in FIG. 3 to the second position shown in FIG. 4. This is accomplished, after removal of the baseboard moldings, by the insertion of a crowbar or other panel extraction tool into the gap between the bottom of the tongue 31 and the top of the floor track 45. Sufficient force is applied to the panel extraction tool to raise the panel to the position shown in broken lines, thereby causing the tongue 31 to be raised upward in the direction of arrow 51. While maintaining this continuous upward force on the tongue using the panel extraction tool, a pushing force is applied perpendicular to the panel facing on the same side from which the panel extraction tool has been inserted, thereby causing the wall panel unit which has been disengaged to tilt obliquely from its vertical position to that indicated by broken lines in FIG. 5.

FIG. 6 shows in solid outline, the tongue in the retracted position, corresponding to that in FIG. 4, and, in broken lines, the tongue in its original interlocking position corresponding to that in FIG. 3.

From the foregoing, it can be readily appreciated that upon removal of an individual panel unit from its position in a partition, it can be replaced with a functional substitute, such as a doorway, as is shown in FIG. 1. After removal of one of the standard panel units according to the procedure described above, it is replaced with a unit having a full-height channel bracket adapted for use as a groove, for interlocking relationship with the tongue of an adjoining standard panel unit. A hinged door is attached to the channel bracket. Where the doorway does not extend for the full height of the partition, the area between the top of the door and ceiling can be filled in with a skirt panel 62. Where an oppositely hinged door is desired, the standard panel unit can be replaced with a door unit having a channel bracket and retractable tongue mounted by means of a plurality of the first and second slotted tongue retraction brackets, to which the hinged door is mounted. Where the door is hinged on the side requiring a channel bracket for use as a groove, the exposed edge of the adjoining unit which, except for the presence of the doorway, would otherwise also be adapted for use as a groove can be covered with a plate so as to adapt the channel as a door jam. A notch may be installed in this plate to cooperate with a spring latch or bolt on the door. Where a standard panel unit is replaced with a door unit, the baseboard molding 41 affixed to the adjacent panel units is replaced with a shorter baseboard which does not extend into the path of the doorway, so as to enable the door to be freely swung open and closed.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

What is claimed is:

1. A modular panel unit comprising:

first and second plates having the planes of their surfaces in parallel orientation to one another;

first and second vertically oriented U-shaped channel brackets perpendicularly affixed to the inner surfaces of the plates at their respective outer edges;

a vertically oriented U-shaped tongue of narrower width than the channel brackets so as to freely move within the channel brackets;

a plurality of tongue retraction brackets each having a slotted opening, affixed to the inside of the channel bracket in one edge of a panel unit at specified positions;

a plurality of other tongue retraction brackets, attached to the tongue at specified positions corresponding to the positions of the slotted tongue retraction brackets and having connecting means mounted thereon such that the connecting means cooperate with the slotted openings in the slotted tongue retraction brackets.

2. The panel unit of claim 1 wherein the slotted opening in the slotted tongue retraction bracket has a first vertically oriented portion and a second obliquely oriented portion.

3. A modular panel unit comprising:

first and second plates having the planes of their surfaces in parallel orientation to one another;

first and second vertically oriented U-shaped channel brackets perperdicularly affixed to the inner surfaces of the plates at their respective outer edges;

a vertically oriented U-shaped tongue of narrower width than the channel brackets so as to freely move within the channel brackets;

a plurality of slotted L-shaped tongue retraction brackets, having a base and a side such that the base of the bracket is affixed to the inside of the channel bracket at one vertical edge of the panel unit at specified positions in the channel bracket;

a plurality of other L-shaped tongue retraction brackets, having a base and a side, such that the base is affixed to the tongue, and having connecting means mounted on the sides thereof, such that the connecting means cooperate with the slotted openings in the slotted L-shaped tongue retraction brackets.

4. The panel unit of claim 3 wherein an the connecting means mounted on the side of an other L-shaped tongue retraction bracket, which cooperates with the slotted opening in a slotted L-shaped tongue retraction bracket is a pin.

5. The modular panel unit according to claim 3 wherein the first and second plates have first and second panel facings, respectively, attached thereto.

* * * * *